US007658131B1

(12) United States Patent
Rosa et al.

(10) Patent No.: US 7,658,131 B1
(45) Date of Patent: Feb. 9, 2010

(54) SUBSEA TENSIONER SYSTEM

(75) Inventors: Peter A. Rosa, Tomball, TX (US); John Micallef, Manilva (ES)

(73) Assignee: Titan Technologies International, Inc., Houston, TX (US)

( * ) Notice: Subject to any disclaimer, the term of this patent is extended or adjusted under 35 U.S.C. 154(b) by 0 days.

(21) Appl. No.: 12/108,387

(22) Filed: Apr. 23, 2008

(51) Int. Cl.
*B25B 29/02* (2006.01)

(52) U.S. Cl. ..... 81/57.38

(58) Field of Classification Search ..... 81/57.38; 405/169, 170
See application file for complete search history.

(56) References Cited

U.S. PATENT DOCUMENTS 4,998,453 A * 3/1991 Walton et al. ..... 81/57.38
5,231,912 A * 8/1993 Akasaka et al. ..... 91/499

FOREIGN PATENT DOCUMENTS

JP 04176575 A * 6/1992

* cited by examiner

*Primary Examiner*—Sunil Singh
(74) *Attorney, Agent, or Firm*—Buskop Law Group, PC; Wendy Buskop

(57) ABSTRACT

A subsea tensioner system that includes a one or more spring activated piston return subsea tensioners. The subsea tensioner system can use a spring activated subsea tensioner because the subsea tensioner system uses non-toxic fluid to drive a piston disposed within the subsea tensioner, and when the piston reaches a second position a fluid release valve is opened thus allowing the fluid used to drive the piston to be emptied into the local underwater environment. The subsea tensioner system eliminates the need for topside trips to return the piston to an initial position to take another stroke.

19 Claims, 10 Drawing Sheets

SUBSEA TENSIONER SYSTEM

FIELD

The present embodiments relate generally to a subsea tensioner system and a method for performing subsea tensioning of a threaded connector underwater.

BACKGROUND

A need exists for a subsea tensioner system that uses a mechanically activated piston return subsea tensioner. Traditional subsea tensioner systems have been unable to use a mechanically activated piston return mechanism such as a spring activated piston return mechanism on subsea tensioners because of the difficulty in returning fluid to the high pressure pump topside. Therefore, a need exists for a subsea tensioner system that releases the fluid locally in an underwater environment.

A need exists for a subsea threaded fastener tensioning system and method of using the bolt or stud tensioner that reduces or eliminates the necessity to return the subsea tensioners topside to retract the piston. A need exists for a subsea tensioner that is capable of repetitive strokes in a subsea environment.

The present embodiments of the invention meet these needs.

BRIEF DESCRIPTION OF THE DRAWINGS

The detailed description will be better understood in conjunction with the accompanying drawings as follows.

Figure 1:
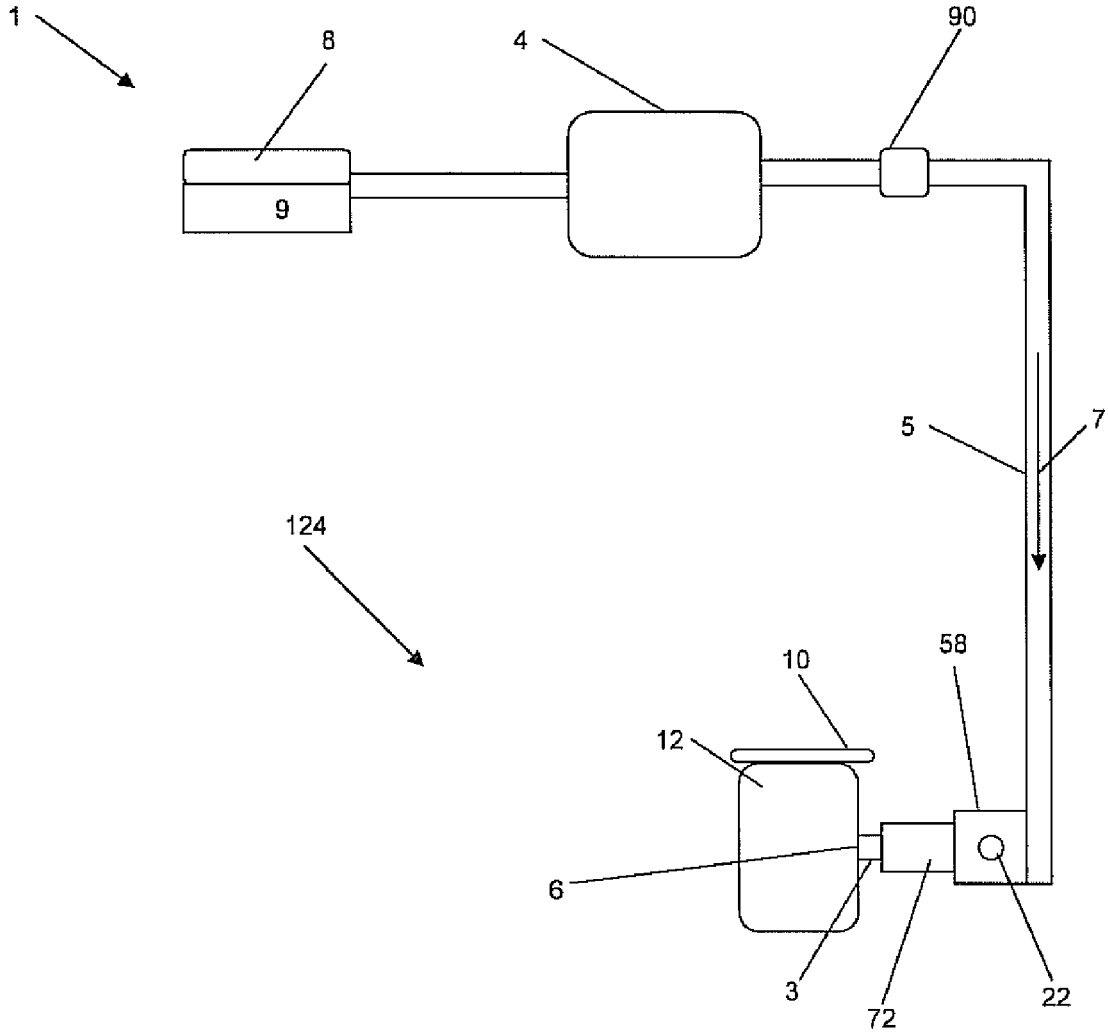
FIG. 1 depicts a schematic of the subsea tensioner system.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The present embodiments of the invention reduce topside trips by a diver or the need to send the subsea tensioners topside by another method. The reduced topside trips increase the efficiency of subsea tensioning. This results in less dive time and reduced operation costs.

The embodiments of the invention provide an increased improvement to threaded fastener tensioning systems to date. The embodiments of the invention allow for the use of a spring return activated subsea tensioner, which was not possible with subsea tensioning systems to date. The embodiments of the invention reduce the energy needed to return fluid topside, by directly releasing the fluid into the local subsea environment. The fluid is a non-toxic environmentally friendly fluid.

The subsea tensioner system can be used to tension a threaded connector underwater. The subsea tensioner system can include a high pressure pump. The high pressure pump can produce a pressure ranging from about 1 psi to about 50,000 psi. The high pressure pump can be in fluid communication with at least one subsea inlet port, in fluid communication with at least one subsea tensioner. The high pressure pump can be disposed above the water or the high pressure pump can be a submersible high pressure pump.

The subsea inlet port can have a nipple for connecting to a hose connected to the high pressure pump. The inlet port can have a diameter from about ⅛ inch to about 4 inches. The inlet port can be adapted for receiving a quick connect. The quick connect can be a traditional quick connect used in subsea activities, such as a CEJN connector. The high pressure pump can provide pressurized fluid from a non toxic fluid storage source, such as a water storage tank, to the at least one subsea tensioner.

The subsea tensioner can have a main body. A piston can be disposed in the main body. The piston can be in fluid communication with an inlet channel. The piston can have an inner and outer diameter sufficient to the task. The inlet channel can have a flow area necessary to achieve the proper threaded connector load desired in the required time. An example of a subsea tensioner useable with the subsea tensioner system is a subsea tensioner available from Titian Technologies International, Inc., of Houston, Tex. model number A4-ST6, which has a max stroke of about 0.79 inch. The inlet channel can be in fluid communication with the subsea inlet port. The desired load achieved would be a function of the given area of the piston times the hydraulic pressure. For example, if a 100,000 psi bolt load is desired using a 2 inch piston area, the hydraulic pump pressure needs to be about 50,000 psi.

The threaded connector can be a bolt, a stud, a tubular, a riser for supporting a vessel, a threaded shaft, or similar subsea connectors.

The piston can repeatabley travel from an initial position to a second position. The initial position is the position of the piston before the introduction of the pressurized fluid. The second position is the position when the piston has reached its preset stroke. The stroke or strokes necessary can be determined and preset dependent on the specification of the bolting task. The necessary stroke or strokes necessary to deliver the required bolt load is determined by Hooks Law.

The subsea tensioner can be used to align to underwater segments. The necessary stroke or multiple of strokes necessary for alignment is variable from segment to segment.

As the piston travels to the second position it applies pressure to a puller. The puller can be threaded to mate with the threads on the stud or bolt being tensioned. The puller can be secured to the threaded connector and applies load to the threaded connector as the piston advances from the initial position to the second position. The puller can be a segmented nut as is known in the art.

A stroke indicator can be disposed in the body and connected to the piston. The stroke indicator can be a lever that moves proportional to the piston, and provides a visual display to a diver. The stroke indicator can be an electronic sensor, a mechanical device, or similar device commonly used on tensioners in a subsea environment.

An over-stroke preventer can be disposed in the main body to prevent the piston from exceeding a maximum second position. "Over Stroke" is a position beyond the maximum second position and is the position where the piston can cause seal extrusion. The stroke limiter prevents the possibility of seal extrusion, thereby, eliminating the need to replace extruded seals and the need to return the tensioner topside for such task.

A return actuator is disposed within the main body and can be secured to the over stroke preventer. The return actuator can be engaged with the piston for returning the piston to the initial position when pressure is released locally from the subsea tensioner(s). The return actuator can be a spring, an electronic actuator, a plurality of springs, a double acting hydraulic piston within the subsea tensioner or similar actuating devices. An example of the return actuator can be a series of springs disposed within a housing. The number of springs can vary depending on the task.

The subsea tensioner can have a fluid release valve in fluid communication with the inlet channel or an internal pressure chamber. An output port can be formed into the fluid release valve for exiting the fluid to the underwater environment when the fluid release valve is opened.

The fluid release valve can be a ball valve, a check valve, butterfly valve, spring valve, or similar fluid release valve. The pressure relief valve can be an individual, one mounted on each individual tensioner or a common pressure relief valve mounted in line or at a T-connection into the harness interconnected to various tensioners at the same time.

It is contemplated that a fluid release valve can be disposed in, or otherwise in fluid communication, with a quick connect. The quick connect can be disposed between the subsea tensioner and the high pressure pump. The quick connect can be secured to the inlet port. In this embodiment when the high pressure fluid flow from the high pressure pump is discontinued, the fluid release valve can be opened putting the outlet port in fluid communication with the inlet port allowing fluid to exit the outlet port under the pressure by the springs or other return actuator mechanism.

The fluid from the fluid source can be water, sea water, a water with a non-toxic thickening additive, or a similar non-toxic fluid such as a food quality organic oil. The non-toxic thickening additive can be a powder such as corn starch or other food quality thickener or glycerin. The fluid can be dyed with an organic dye, such as food coloring.

A manual actuator can be disposed on the fluid release valve for opening the fluid release valve allowing the fluid to flow through the pressure relief valve and exit to the underwater environment.

The embodiments of the invention also relate to a method for performing subsea tensioning of a threaded connector underwater.

The method includes pressurizing a fluid and providing the fluid to a subsea tensioner. The fluid can be pressurized in a high pressure pump located on the surface and provided to the subsea tensioner by a hose connected to the high pressure pump and an inlet port for the subsea tensioner. Then pressurized fluid can move the piston causing the piston to apply pressure to a puller secured to a threaded connector.

When the piston reaches a second position or the fastener or fasteners are tight, thus creating an equilibrium between tensioner pressure and fastener material resistance, the nut on the fastener is turned to maintain the bolt in its now new position. Once the nut or nuts are manually run down, the fluid is depressurized by shutting down the high pressure pump and opening the pressure return valve on the pump or closing a valve between the subsea tensioner(s) and the high pressure pump.

A fluid release valve can be opened. The fluid can then be forced out of the subsea tensioner through an outlet port into the local underwater environment. Eliminating the need for the hydraulic fluid to travel the distance from the tensioner(s) back to the topside high pressure pump, via the down pipe, thus allowing the springs to return the piston to the desired first position.

The embodiments of the invention can be best understood with the reference to the figures.

FIG. 1 is a schematic of the subsea tensioner system 1 is depicted. The subsea tensioner system 1 is depicted having a high pressure pump 4 in communication with a fluid source 8. The fluid source 8 contains a fluid 9, such as water, demineralized water or sea water. The pressurized fluid 7 is pressurized in the high pressure pump 4, and is provided to the subsea tensioner(s) 10, through the hose 5. The hose 5 is depicted connected to the subsea inlet port 6, by the use of a quick connect 72 secured to a nipple 3 on the subsea inlet port 6. The nipple 3 can also be part of the coupler and threaded directly into the tensioner(s). The quick connect 72 is depicted having a fluid release valve 58, with an outlet port 22. A high pressure valve 90, such as a high pressure needle valve or equivalent valve suitable for the pressure, can be used to disconnect the pump 4 from the hose 5.

The subsea tensioner 10 has a main body 12 containing the subsea inlet port 6. The subsea tensioner 10 is disposed in a local underwater environment 124.

Figure 2A:
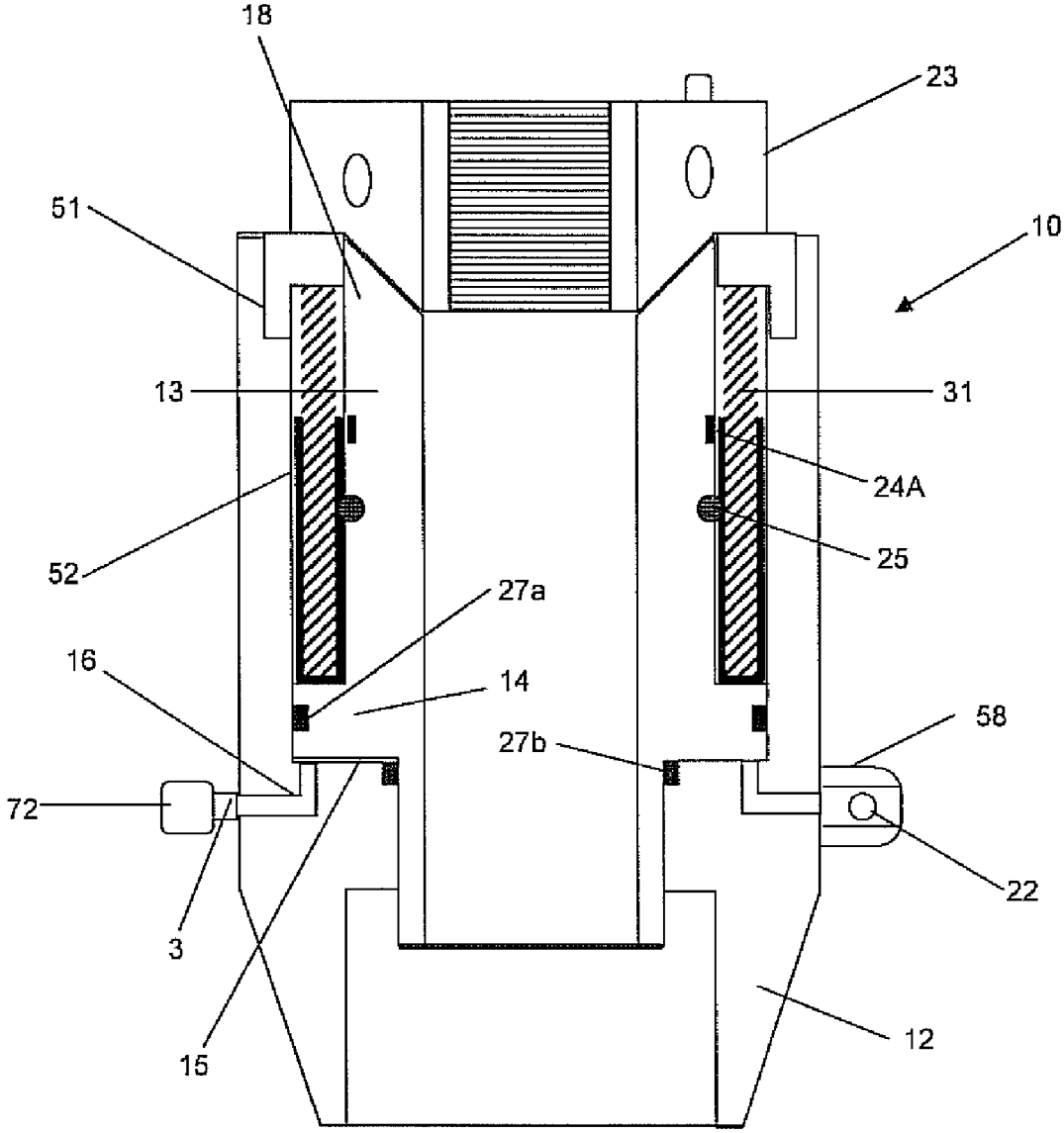
FIG. 2A depicts a cut view of a main body of a subsea tensioner with a piston in an initial position.
Figure 2B:
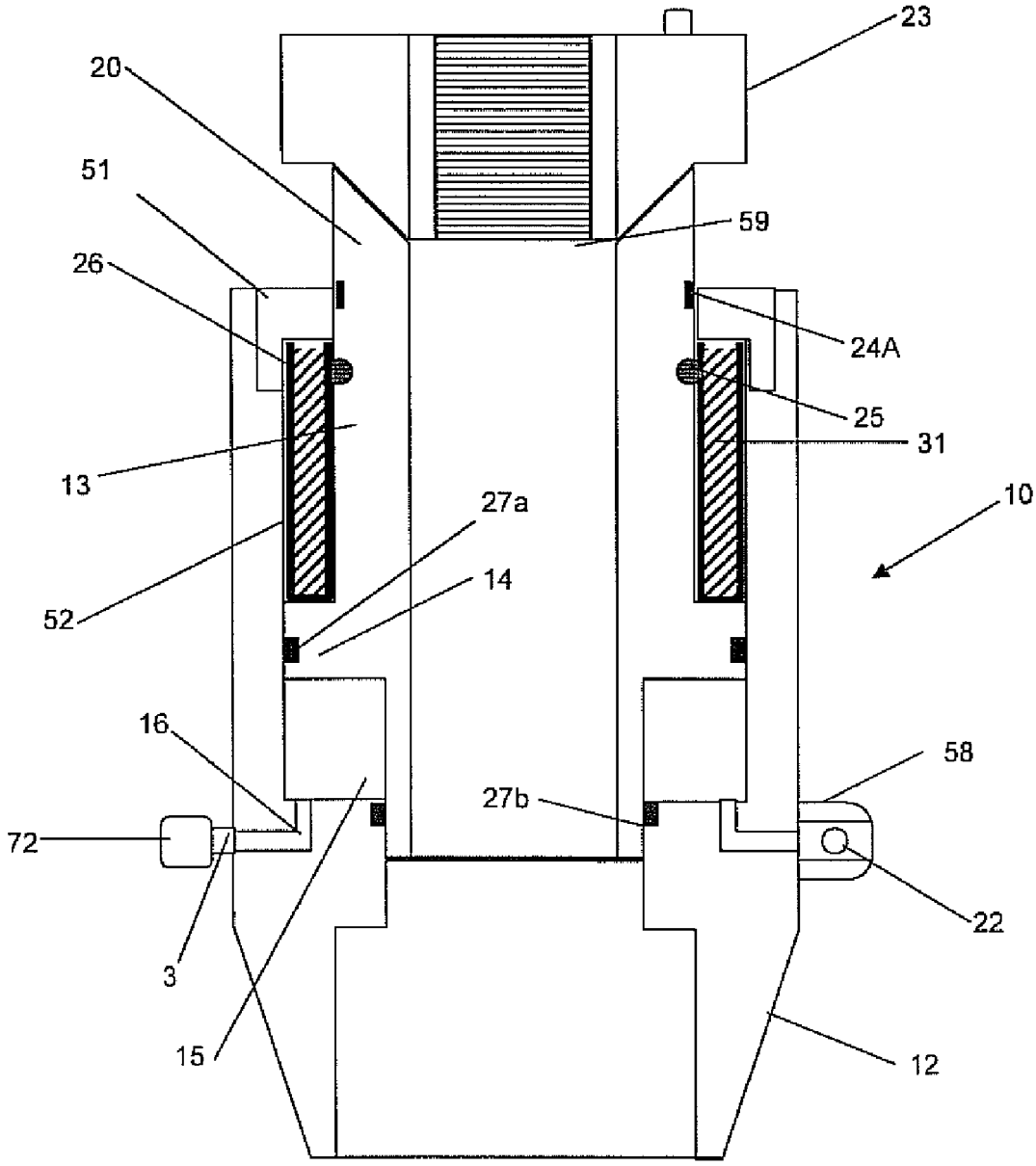
FIG. 2B depicts a cut view of a main body of a subsea tensioner with a piston in a second position.

Referring now to FIG. 2A and FIG. 2B, which depicts a cut view of the subsea tensioner 10. The main body 12 can be seen having an inner body 13. The piston 14 is disposed within the main body 12 on the inner body 13. Main Body 12, with inner body 13 and primary seals 27*a* and 27*b* form a pressure chamber 15.

The inner body 13 and main body 12 can be made from metal, composite, or similar hard materials.

The piston 14, an integral part of inner body 13, and is in fluid communication with the inlet channel 16. The piston 14 is in an initial position 18, as shown in FIG. 2A. The piston 14 is engaged with the puller 23. The return actuator 31 is engaged with the piston 14. The return actuator 31 is depicted as a series of coil springs; however, a different mechanical or hydraulic actuator could be used. A stroke indicator 24A is depicted engaged with the inner body 13. The stroke indicator 24A can be used to indicate the maximum stroke position of the piston 14 to a diver. The stroke indicator 24A can be a mechanical stroke indicator. The stroke indicator can be machined into the inner body.

The stroke indicator 24A can be engaged with the piston 14 by being machined into it, glued to it or impinged on the metal surface. The return actuator 31 can be engaged with the piston by means of retaining cap 51.

An environmental seal 25, which can be an o-ring, a machined ring, a gasket, or a self-sealing machined sealing configuration, such as a feathered edge, is disposed on the inner body 13. A first primary seal 27*a* and a second primary seal 27*b* are disposed on the inner body 13 and main body 12 respectively. The return actuator 31 is disposed in an actuator housing 52.

A fluid release valve 58 is connected to the main body 12. An outlet port 22 is formed into the fluid release valve 58, for exiting the fluid from the pressure chamber 15 via the inlet channel 16 into the local underwater environment.

In FIG. 2*b* the piston 14 and inner body 13 can be seen in a second position 20. The maximum second position 59 is also depicted, but the piston 14 is short of the maximum second position 59. The piston 14 is kept from exceeding the maximum second position 59 by the stroke limiter 26. The stroke limiter prevents over stroke of the piston 14 by coming to a physical stop against retainer cap 51.

Figure 3:
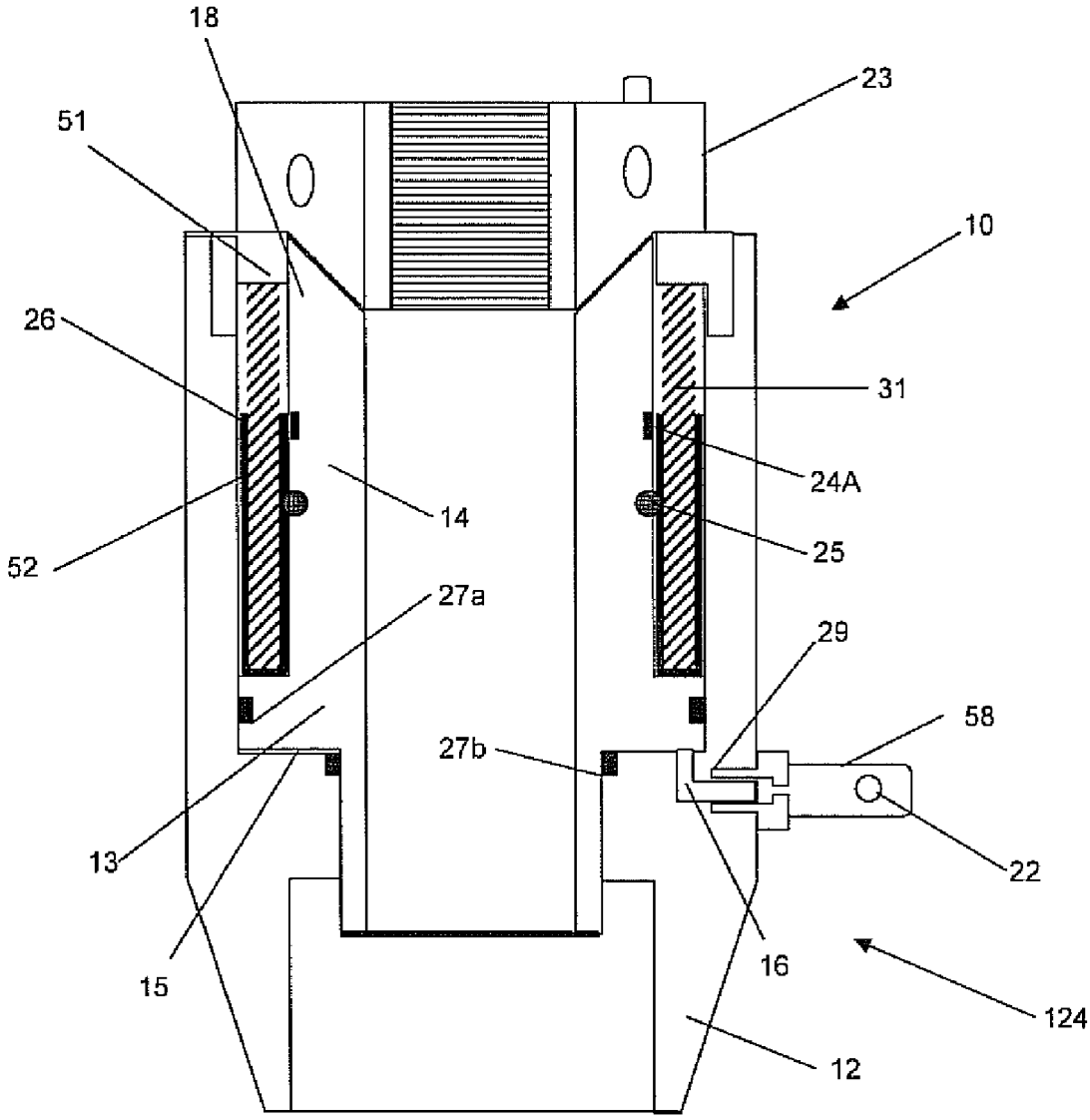
FIG. 3 depicts a cut view of the subsea tensioner with a fluid release valve.

FIG. 3 depicts a cut view of the subsea tensioner 10 with the fluid release valve 58 secured to the main body 12, and in fluid communication with the inlet channel 16 and pressure chamber 15. The fluid release valve 58 can be secured to the main body 12 with a threaded connection. A seal 29 is disposed between the main body 12 and the fluid release valve 58. The outlet port 22 is depicted in the pressure relief valve 58. The outlet port 22 can be a cross drilled port. The outlet port 22 allows fluid from the pressure chamber 15, either through the inlet channel 16 or in the alternative directly, to enter the local underwater environment 124 as the return actuator 31 returns the piston 14 to initial position 18. The outlet port 22 is put in fluid communication with the pressure chamber 15 and the inlet channel 16 when the fluid release valve 58 is opened.

Figure 4:
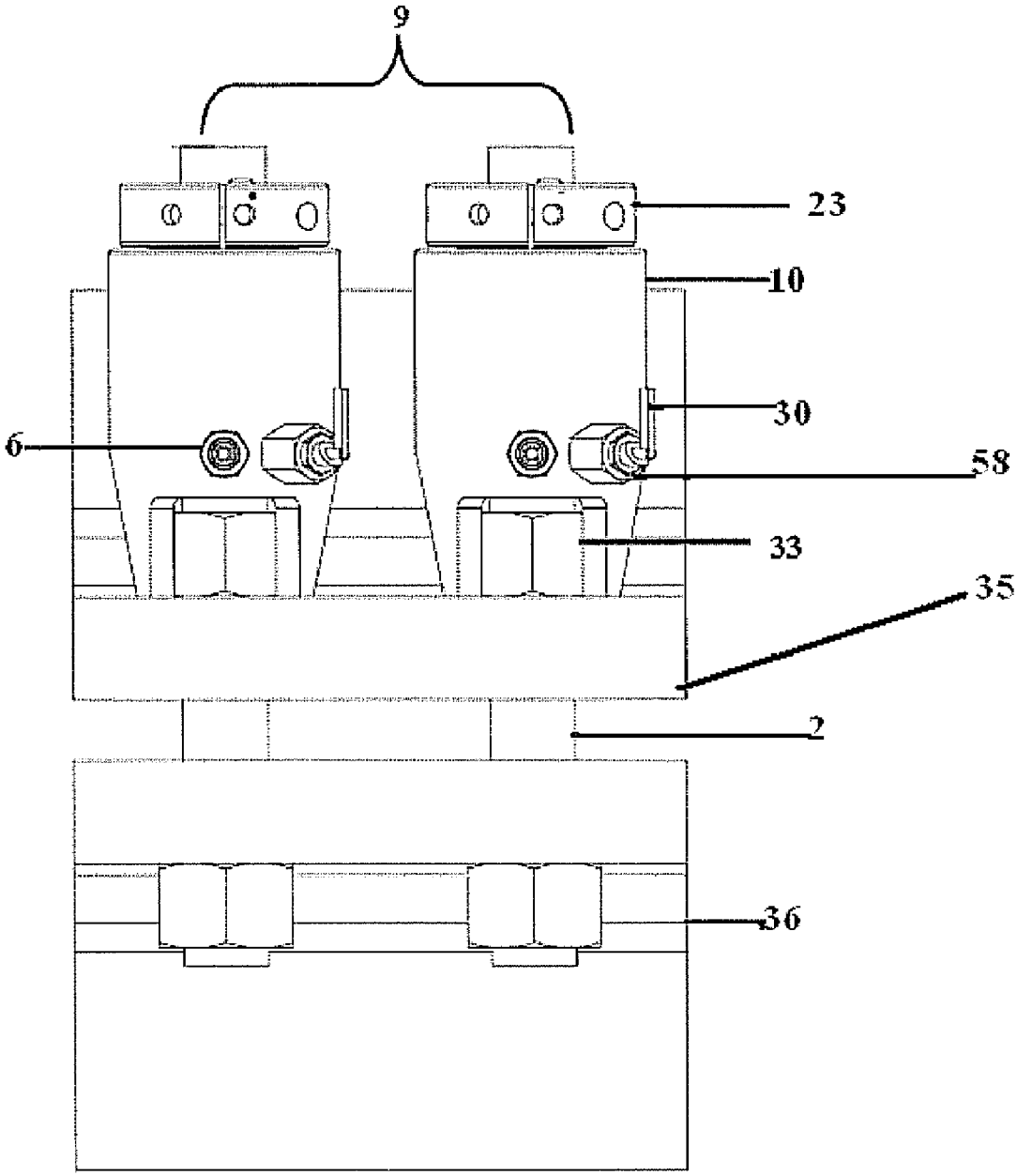
FIG. 4 depicts a plurality of the subsea tensioners aligning two subsea flanges.

FIG. 4 depicts a plurality of subsea tensioners 9. Each of the subsea tensioners has a puller 23, an subsea inlet port 6, a fluid release valve 58. Each subsea tensioner 10 is engaged with a threaded connector 2. As the piston 14 moves towards the second position 20, not shown in this Figure, the puller is caused to put a load on the threaded connector 2. When the piston reaches the second position a diver can tighten the nut 33. Then the pressure release valve 58 can be opened using the manual actuator 30, and the high pressure pump 8 can be shut down depressurizing the fluid in the inlet channel 16. As the piston returns to the initial position the fluid in pressure chamber 15 via the inlet channel 16 is forced out of the outlet port 22 formed in the fluid release valve 58.

The plurality of subsea tensioners can be in fluid communication with each other by subsea inlet port 6. For example subsea inlet port 6 of a first subsea tensioner can be connected, for example by a hose, to a subsea inlet port 6 of a second subsea tensioner. The inlet ports can be connected to the hose by the use of couplers inserted into the subsea inlet ports. For example a nipple can be used or a female connect of a quick connect can be secured to the inlet port and a male connect of a quick connect can be secured to the hose.

The threaded connector 2 is engaged with a first underwater segment 35 and a second underwater segment 36. The plurality of subsea tensioners 9 can be used to align the first subsea segment 35 with the second underwater segment 36. The subsea segments can be moved by the plurality of subsea tensioners 9. A single subsea tensioner or the plurality of subsea tensioners 9 can move the subsea segments a distance ranging from about 0 inches to about 30 inches. The distance can be larger if the alignment task requires.

With traditional subsea tensioner system the plurality of subsea tensioners would have to be sent topside each time the piston reaches the second position, for piston retraction to the initial position. The current embodiments of the invention eliminate the need to go topside each time the piston reaches the second position. The elimination of the need to go topside reduces the dive time of a diver. Thus, the embodiments of the subsea tension system greatly reduce the time involved with subsea tensioning systems and the costs associated with subsea tensioning such as barge time, diver time, and other costs associated with subsea tensioning.

Figure 5A:
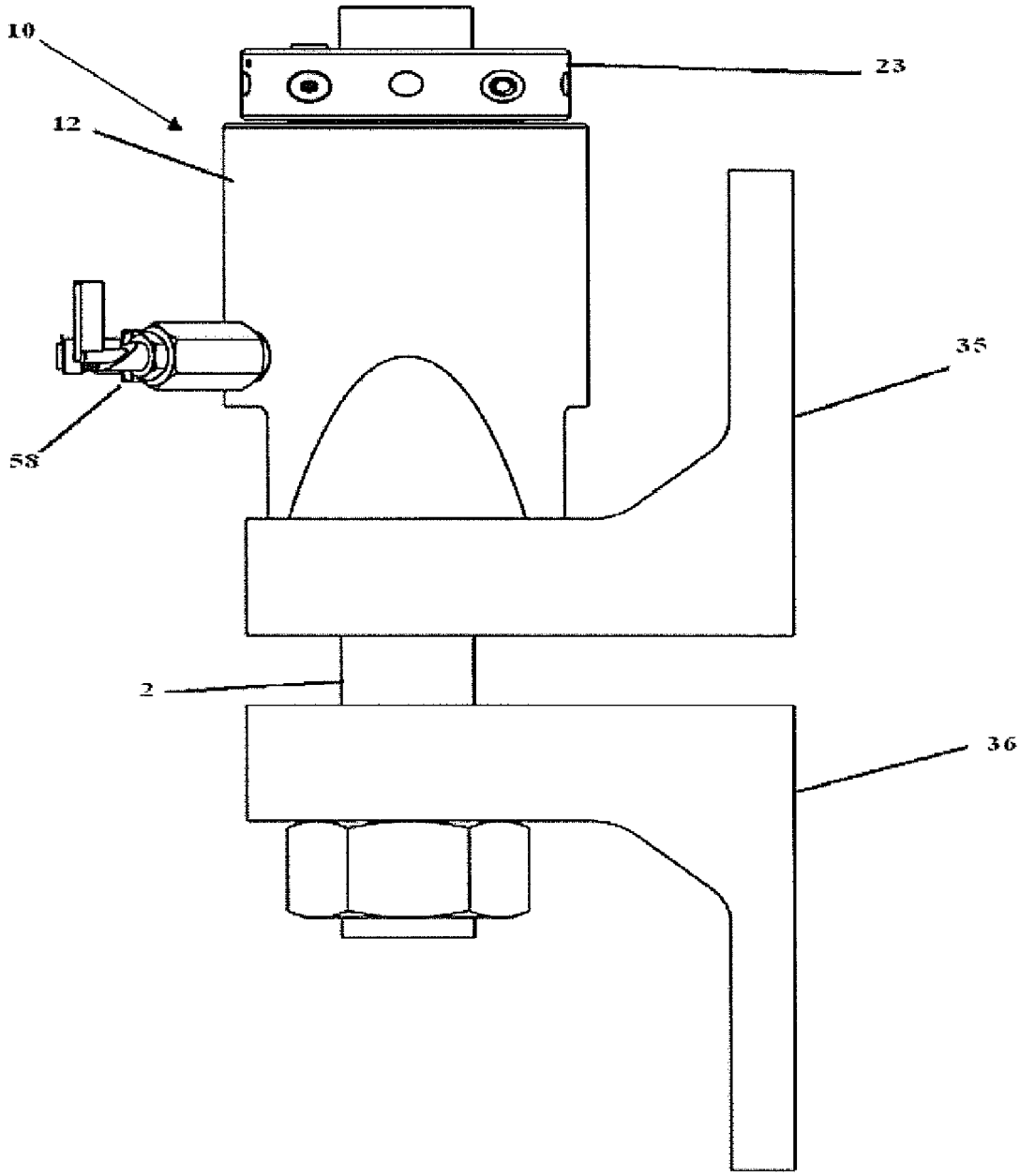
FIG. 5A depicts a side view of the subsea tensioner for loading a threaded connector.
Figure 5B:
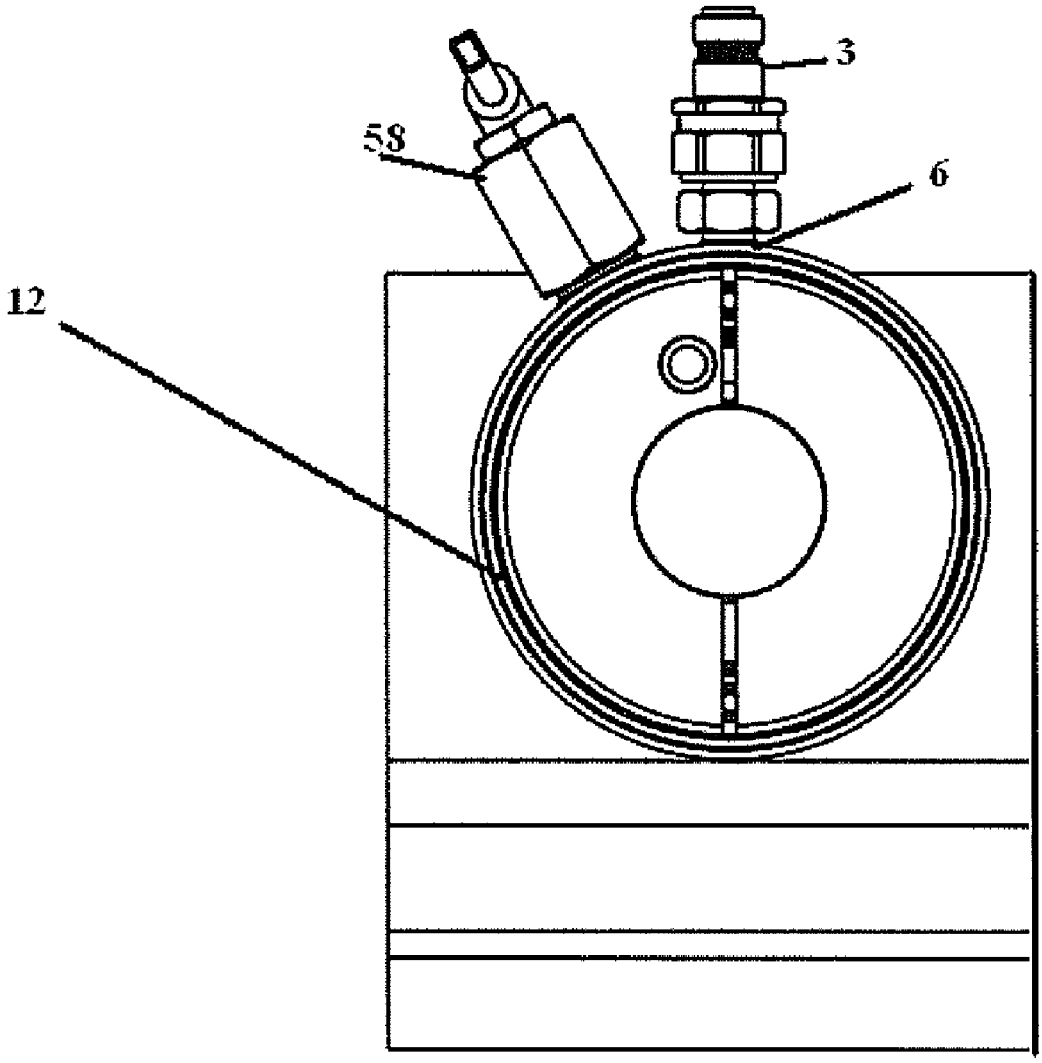
FIG. 5B depicts a top view of the subsea tensioner for loading a threaded connector.

FIG. 5A depicts a single subsea tensioner 10 engaged with the first segment 35 and the second segment 36, connected by a threaded connector 2. FIG. 5B depicts the top view of the subsea tensioner 10. In FIG. 5*b* a nipple 3 is depicted secured to the subsea inlet port 6.

Figure 6:
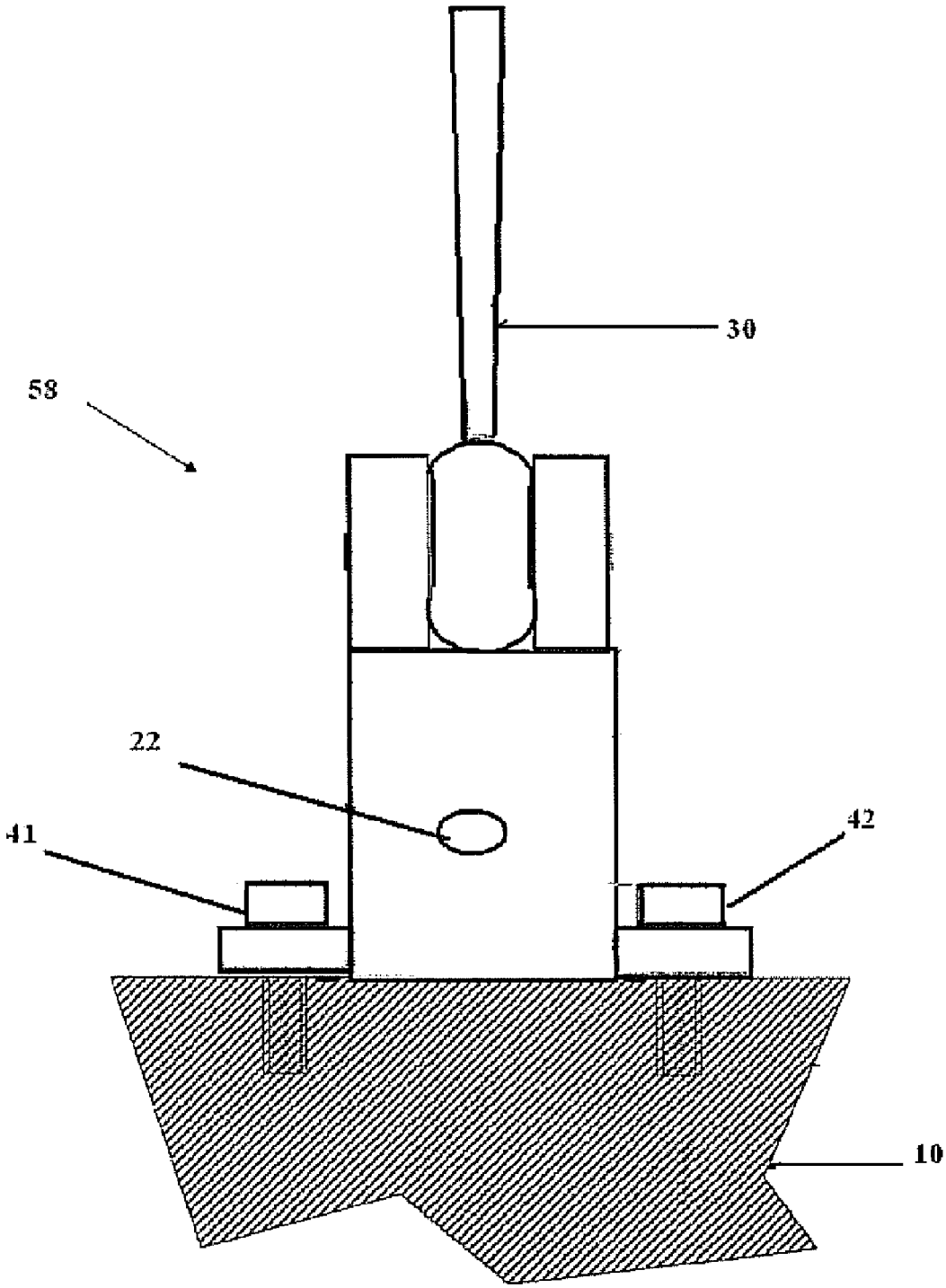
FIG. 6 depicts an embodiment of the pressure relief valve.

FIG. 6 depicts an embodiment of the fluid release valve 58 secured to the subsea tensioner 10. The fluid release valve 58 is depicted secured to the subsea tensioner 10 by the use of a first cap screw 41 and a second cap screw 42. There can be more cap screws or other type of fasteners used suitable to the task. In another embodiment, the main body 12 of the subsea tensioner 10 can have a threaded cavity formed in the main body 12, and in fluid communication with the inlet channel 16. The fluid release valve can have a threaded segment adapted to engage the threaded cavity formed into the main body 12.

The fluid release valve 58 is depicted having a manual actuator 30. The manual actuator 30 can be sized to allow a gloved hand of a diver easy access. For example the manual actuator 30 can have a length ranging from about ½ inch to about 6 inches.

The outlet port 22 can be seen formed into the side of the fluid release valve 58. The outlet port 22 can be a hole cross drilled into the fluid release valve 58. The outlet port 22 can have a diameter ranging from about 1/16 inch to about 1 inch.

Figure 7:
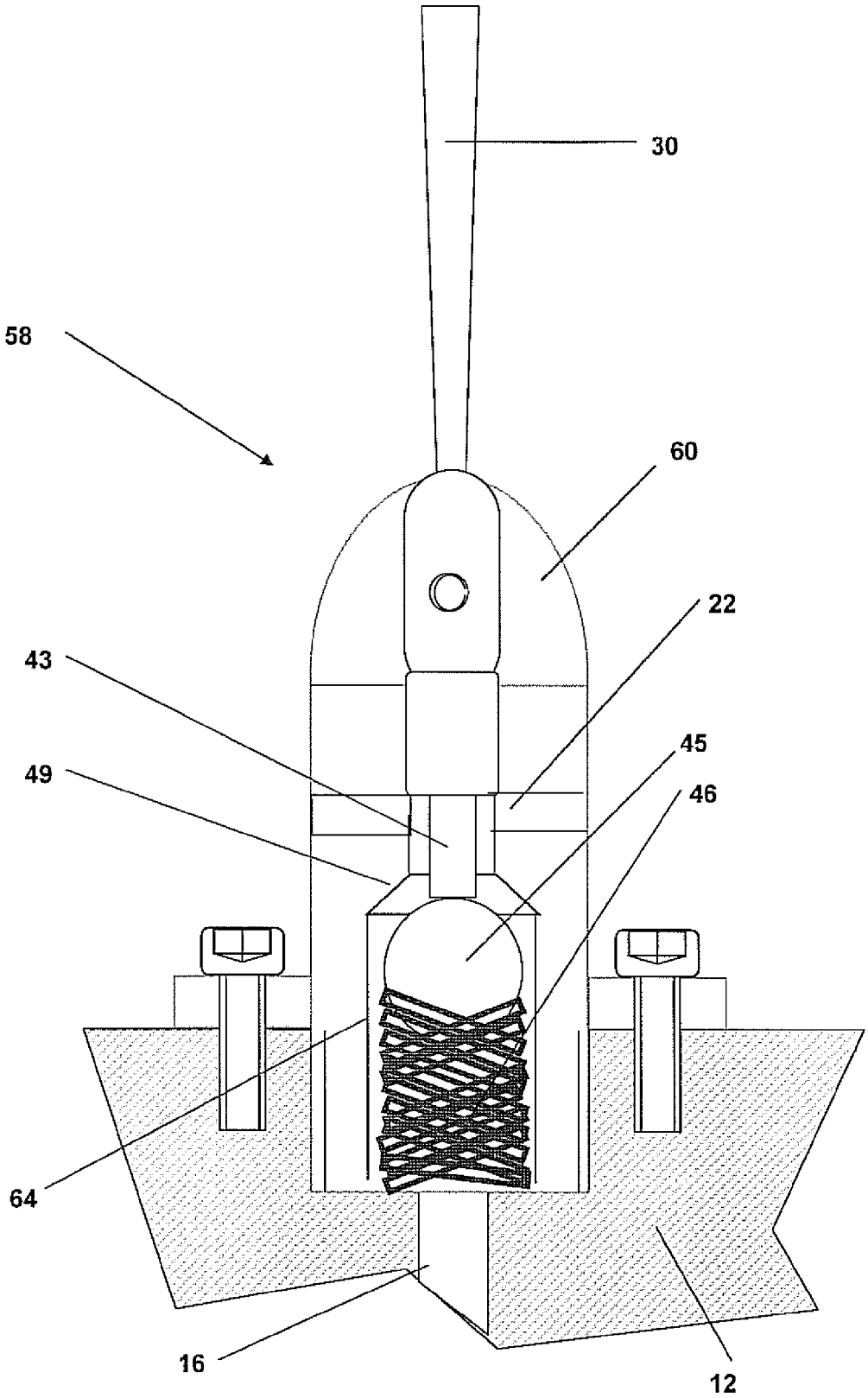
FIG. 7 depicts a cut view of the pressure relief valve.

In FIG. 7 a cut view of the fluid release valve can be seen. The fluid release valve 58 has a main valve body 60. A manual actuator 30 is secured to the main valve body 60. The manual actuator 30 can be used to move a valve piston 43. The valve piston 43 is disposed within the main valve body 60. A ball channel 64 is formed into the main valve body 60.

The manual actuator can be actuated either manually by a diver, a submersible vehicle, or ROV pulling on the manual actuator. In the alternative, the manual actuator can be activated remotely. An example of this can be a radio controlled activator controlled by the diver or from topside or a ROV or submersible vehicle.

The ball channel 64 has a conical seating 49 for seating a ball 45 disposed within the ball channel 64. The ball 45 is held within the conical seating 49 by a spring 46, until the manual actuator 30 is used to force the valve piston 43 down towards the ball 45, effectively disengaging the ball 45 from the conical seating 49. When the ball 45 is disengaged from the conical seating 49 the outlet port 22 is put in fluid communication with the inlet channel 16 and the pressure chamber 15, disposed within the subsea tensioner main body 12.

The outlet port 22 allows the fluid to flow into the local underwater environment 124. When the manual actuator 30 is deactivated the valve piston 43 returns to the original position allowing the ball 45 to engage the conical seating 49. When the ball 45 is seated in the conical seating 49 the outlet port 22 is no longer in fluid communication with the inlet channel 16 or pressure chamber 15.

Figure 8:
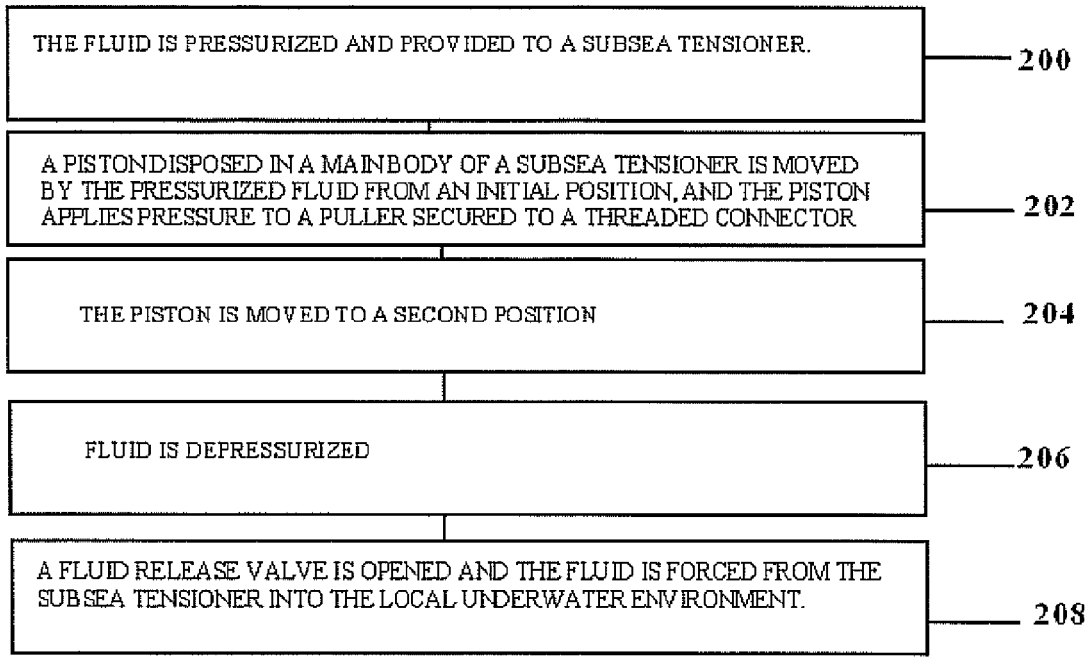
FIG. 8 depicts a flow diagram of a method for using the subsea tensioner system.

FIG. 8 depicts a flow diagram of a method for subsea tensioning of a threaded connector underwater. In step 200 the fluid is pressurized and provided to a subsea tensioner. In step 202 a piston disposed in a main body of a subsea tensioner is moved by the pressurized fluid from an initial position, and the piston applies pressure to a puller secured to a threaded connector.

In step 204 the piston is moved to a second position, then the fluid is depressurized in step 206. In step 208 a fluid release valve is opened and the fluid is forced from the subsea tensioner into the local underwater environment.

While these embodiments have been described with emphasis on the embodiments, it should be understood that within the scope of the appended claims, the embodiments might be practiced other than as specifically described herein.

What is claimed is:

1. A subsea tensioner system for tensioning a threaded connector underwater, wherein the subsea tensioner system comprises:

a. at least one subsea tensioner disposed in an underwater environment, wherein the subsea tensioner comprises:
   i. a main body;
   ii. a piston disposed in the main body, wherein the piston is in fluid communication with an inlet channel, and wherein the inlet channel is in fluid communication with a subsea inlet port that receives a fluid and the inlet channel is in fluid communication with a pressure chamber;
   iii. wherein the piston repeatabley moves from an initial position to a second position, wherein the piston applies pressure from the pressure chamber to a puller as the piston advances from the initial position to the second position, and wherein the puller is secured to the threaded connector and that applies a load to the threaded connector as the piston advances from the initial position to the second position;
   iv. an over stroke preventer is disposed within the main body to prevent the piston from exceeding a maximum second position;
   v. a return actuator is disposed within the main body and secured to the over stroke preventer, wherein the return actuator is engaged with the piston for returning the piston to the initial position, wherein the return actuator is a member of the group consisting of: a spring; an electronic actuator; a plurality of springs; and a double acting hydraulic piston; and
   vi. a fluid release valve is in fluid communication with the inlet channel; and wherein an outlet port is formed into the fluid release valve for exiting the fluid from the inlet channel when the fluid release valve is opened;

b. a high pressure pump in fluid communication with the at least one subsea inlet port and the fluid for pulling the fluid through the subsea inlet port, the inlet channel, and into the pressure chamber for continuous refreshing of the fluid to the high pressure pump;

c. wherein the outlet port releases the fluid to a local underwater environment; and wherein the piston repeatably moves from the initial position, as the fluid is introduced into the pressure chamber by the high pressure pump, to the second position as the fluid is released through the outlet port to the local underwater environment.

2. The subsea tensioner system of claim 1, wherein the fluid release valve is disposed on a quick connect, disposed between the subsea tensioner and the high pressure pump, and wherein the quick connect is secured to the subsea inlet port.

3. The subsea tensioner system of claim 1, wherein the fluid release valve is secured to the main body, and is in fluid communication with the inlet channel.

4. The subsea tensioner system of claim 1, wherein the fluid release valve is disposed proximate to the at least one subsea tensioner, and wherein the fluid release valve is disposed between the high pressure pump and the at least one subsea tensioner.

5. The subsea tensioner system of claim 1, wherein the subsea tensioner system comprises a plurality of subsea tensioners.

6. The subsea tensioner of claim 5, wherein the fluid release valve is in fluid communication with the high pressure pump and with each of the plurality of subsea tensioners simultaneously.

7. The subsea tensioner system of claim 1, wherein the fluid is water, sea water, a water with a non-toxic thickening additive, or a similar non-toxic fluid.

8. The subsea tensioner system of claim 7, wherein the non-toxic thickening additive is glycerin or food quality vegetable oil.

9. The subsea tensioner system of claim 1, wherein a stroke indicator is connected to the piston.

10. The subsea tensioner system of claim 1, wherein the fluid is dyed with an organic dye.

11. The subsea tensioner system of claim 1, wherein the puller is a segmented nut.

12. The subsea tensioner system of claim 1, wherein the fluid release valve is a ball valve, a check valve, spring valve, or similar fluid release valve.

13. The subsea tensioner system of claim 1, wherein a manual actuator is disposed on the fluid release valve for opening the fluid release valve allowing the fluid to flow through the fluid release valve and exit to the local underwater environment.

14. The subsea tensioner system of claim 13, wherein the manual actuator can be remotely actuated from a diving capsule.

15. A method for subsea tensioning of a threaded connector underwater comprising:

a. pressurizing a fluid and providing the fluid to a pressure chamber within at least one subsea tensioner;

b. applying pressure to a puller secured to the threaded connector; by moving a piston from an initial position using the pressurized fluid within the pressure chamber;

c. moving the piston to a second position;

d. depressurizing the fluid within the pressure chamber;

e. opening a fluid release valve in fluid communication with the pressure chamber; and f. forcing the fluid out of the pressure chamber within the subsea tensioner and into the local underwater environment through an outlet port disposed on the fluid release valve.

16. The method of claim 15, wherein the fluid release valve is manually opened.

17. The method of claim 15, wherein the fluid release valve automatically opens when the pressure within the at least one subsea tensioner reaches a preset value.

18. The method of claim 15, wherein the step of depressurizing the fluid comprises shutting down a high pressure pump.

19. The method of claim 18, wherein the step of depressurizing the fluid comprises interrupting the flow of the pressurized fluid from the high pressure pump to the at least one subsea tensioner.

* * * * *